US006764165B2

(12) United States Patent
Aschoff et al.

(10) Patent No.: US 6,764,165 B2
(45) Date of Patent: Jul. 20, 2004

(54) FLUID EJECTION DEVICE AND METHOD OF MANUFACTURING A FLUID EJECTION DEVICE

(75) Inventors: Christopher C. Aschoff, Corvallis, OR (US); William R. Boucher, Corvallis, OR (US); Paul F. Reboa, Corvallis, OR (US); Gilbert G. Smith, Corvallis, OR (US); John M. Altendorf, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/262,406

(22) Filed: Sep. 30, 2002

(65) Prior Publication Data

US 2004/0061741 A1 Apr. 1, 2004

(51) Int. Cl.[7] ..... B41J 2/14
(52) U.S. Cl. ..... 347/50; 347/87
(58) Field of Search ..... 347/63, 64, 49, 347/50, 87

(56) References Cited

U.S. PATENT DOCUMENTS

| | | | | |
|---|---|---|---|---|
| 4,806,106 | A | 2/1989 | Mebane et al. | |
| 5,442,384 | A | 8/1995 | Schantz et al. | |
| 5,442,386 | A | 8/1995 | Childers et al. | |
| 5,515,089 | A * | 5/1996 | Herko et al. | 347/63 |
| 5,903,295 | A | 5/1999 | Swanson et al. | |
| 6,322,200 | B1 | 11/2001 | Feinn et al. | |
| 6,325,491 | B1 | 12/2001 | Feinn | |
| 6,361,160 | B2 | 3/2002 | Feinn et al. | |
| 6,439,698 | B1 * | 8/2002 | Patil | 347/64 |
| 2002/0024551 | A1 | 2/2002 | Saito | |

* cited by examiner

*Primary Examiner*—Anh T. N. Vo

(57) ABSTRACT

A mold configured to be coupled to a fluid ejection head die to allow a protective material to be molded around a plurality of contact pads on the die is disclosed. The mold includes a molding surface configured to cover the contact pads, wherein the molding surface is configured to support and shape the protective material during molding, and at least one side extending away from the molding surface, wherein the side is configured to contain the protective material during molding.

39 Claims, 4 Drawing Sheets

FLUID EJECTION DEVICE AND METHOD OF MANUFACTURING A FLUID EJECTION DEVICE

BACKGROUND OF THE INVENTION

Fluid ejection devices may find uses in a variety of different technologies. For example, some printing devices, such as printers, copiers and fax machines, print by ejecting tiny droplets of a printing fluid from an array of fluid ejection mechanisms onto the printing medium. The fluid ejection mechanisms are typically formed on a fluid ejection head that is movably coupled to the body of the printing device. Careful control of the individual fluid ejection mechanisms, the movement of the fluid ejection head across the printing medium, and the movement of the medium through the device allow a desired image to be formed on the medium.

The fluid ejection mechanisms typically are fabricated on a semiconductor die that forms part of the fluid ejection head, and are controlled by control signals from off-printhead circuitry. To allow the control signals to reach the fluid ejection mechanisms, the fluid ejection die includes one or more electrical contacts for connecting the die to electrical connectors leading to the control circuitry. These contacts (or contact pads) are typically formed on the same surface of the die as the openings of the fluid ejection mechanisms.

Due to the proximity of the contact pads to the openings of the fluid ejection mechanisms on the die surface, it may be possible for fluid to contaminate the contact pad region of the fluid ejection head die during device use. This may cause electrical shorts to form between adjacent leads, and thus may degrade printhead performance.

SUMMARY OF THE INVENTION

The present invention provides a mold configured to be coupled to a fluid ejection head die to allow a protective material to be molded around a plurality of contact pads on the die. The mold includes a molding surface configured to cover the contact pads, wherein the molding surface is configured to support and shape the protective material during molding, and at least one side extending away from the molding surface, wherein the side is configured to contain the protective material during molding.

DETAILED DESCRIPTION

Figure 1:
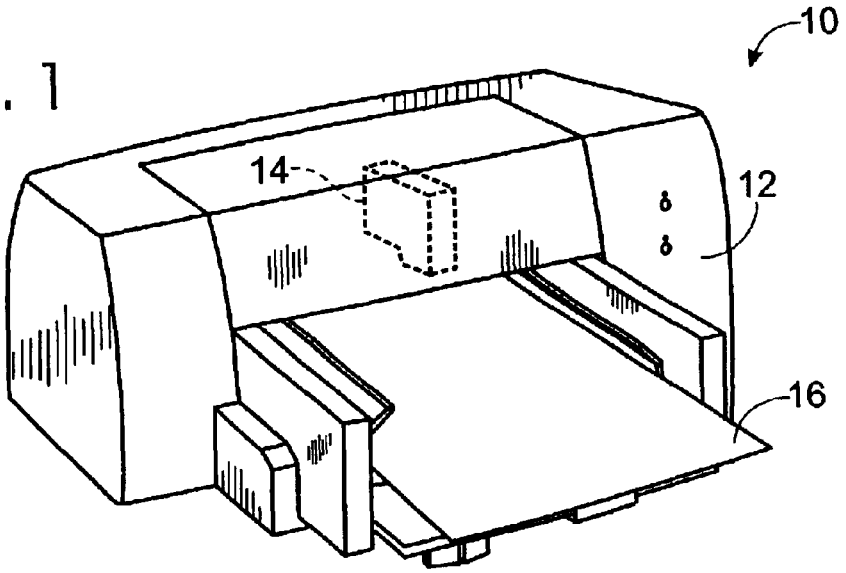
FIG. 1 is an isometric view of a first embodiment of a fluid ejection device according to the present invention.

One embodiment of a fluid ejection device according to the present invention is shown generally at 10 in FIG. 1 as a desktop printer. Fluid ejection device 10 includes a body 12, and a fluid ejection cartridge 14 operatively coupled to the body. Cartridge 14 is configured to deposit a fluid onto a medium 16 positioned adjacent to the cartridge. Control circuitry in fluid ejection device 10 controls the movement of cartridge 14 across medium 16, the movement of the medium under the cartridge, and the firing of individual fluid ejection mechanisms on the fluid ejection cartridge.

Although shown herein in the context of a printing device, a fluid ejection device according to the present invention may be used in any number of different applications. For example, a fluid ejection device according to the present invention may be used to eject an aerosol, or may find any of a number of uses in an analytical microfluidic system. Furthermore, while the depicted printing device takes the form of a desktop printer, a fluid ejection device according to the present invention may take the form of any other suitable type of printing device, and may have any other desired size, large- or small-format.

Figure 2:
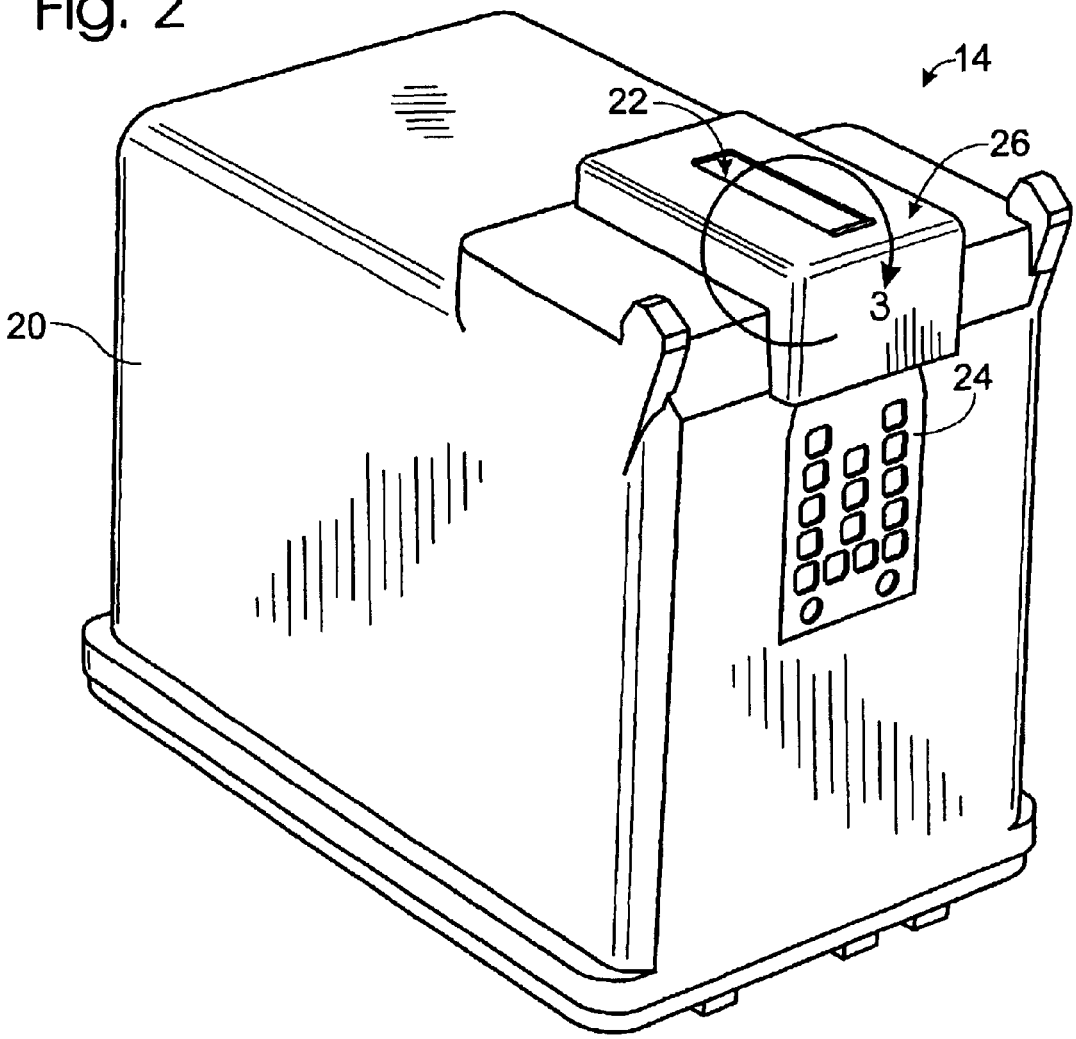
FIG. 2 is an isometric view of a fluid ejection cartridge of the embodiment of FIG. 1.

FIG. 2 shows the bottom of cartridge 14 in more detail. Cartridge 14 includes a cartridge body 20 configured to hold a volume of fluid, and a fluid ejection head 22 coupled to the cartridge body and configured to eject fluid onto medium 16. An elongate electrical connector 24 is coupled with fluid ejection head 22 and a side of cartridge body 20 to allow fluid ejection head 22 to be connected to external control circuitry. Electrical connector 24 may take the form of a flexible ribbon circuit, and may include a plurality of individual conductive traces or wires to allow power to be provided separately to each fluid ejection mechanism. While fluid ejection head 22 is depicted in FIG. 2 as being attached to cartridge 14, it will be appreciated that a fluid ejection device according to the present invention may also have a fluid ejection head and a fluid supply positioned remotely from one another.

If left exposed, the connections between electrical connector 24 and fluid ejection head 22 may be susceptible to damage from such sources as electrical shorts caused by fluid contamination or fluid exposure of the leads, and mechanical damage caused by wiping structures commonly found in fluid ejection devices. Thus, fluid ejection device 10 also includes a protective barrier, indicated generally at 26, disposed over selected portions of fluid ejection head 22 to cover and/or encapsulate the electrical connections between electrical connector 24 and fluid ejection head 22.

Figure 3:
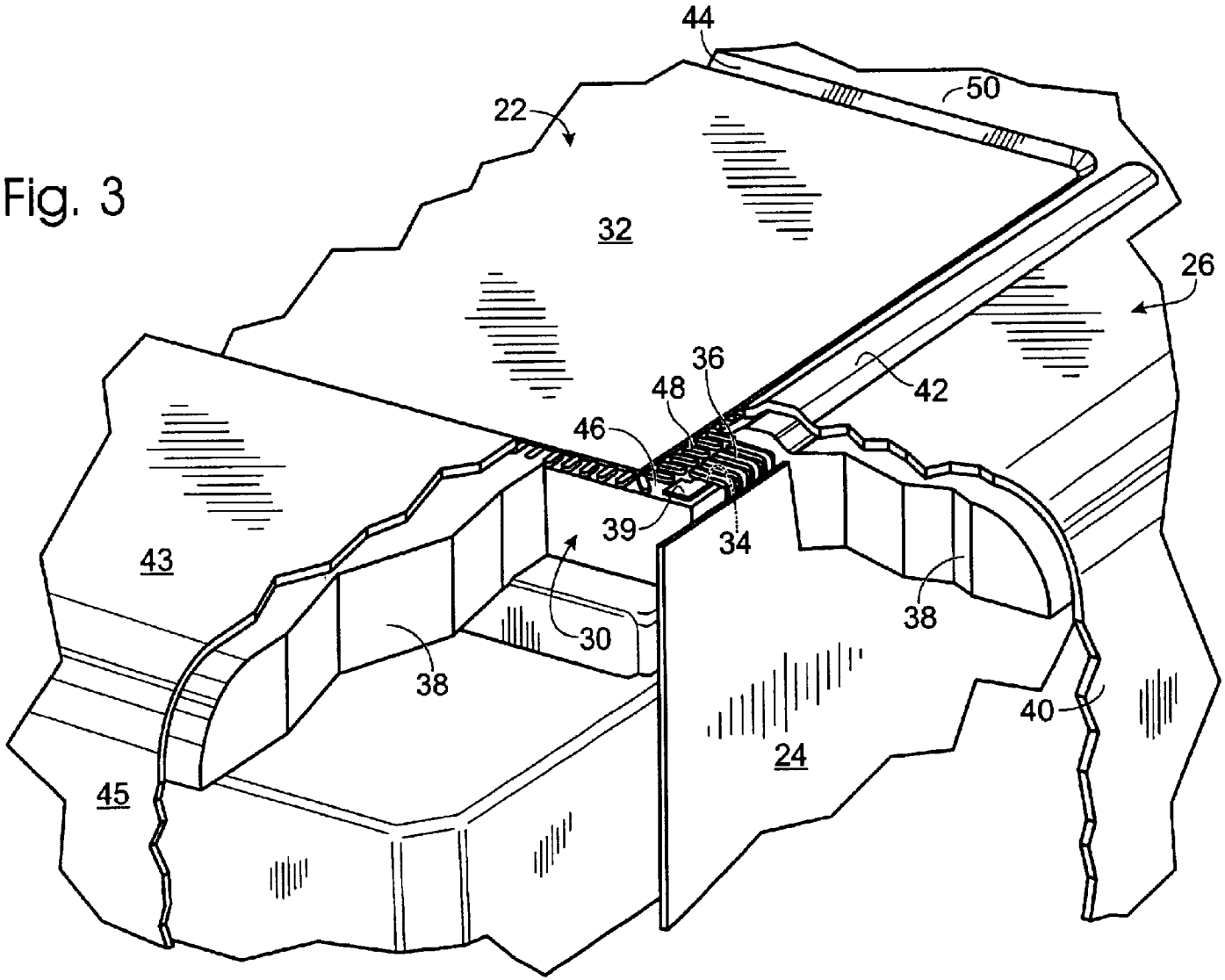
FIG. 3 is a partially broken-away isometric view of a protective barrier of the fluid ejection cartridge of the embodiment of FIG. 1.
Figure 4:
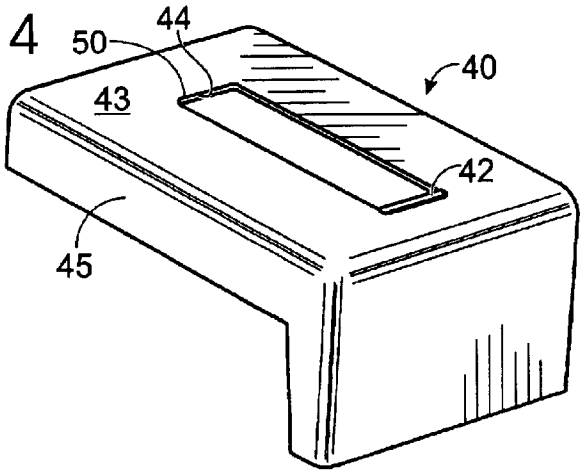
FIG. 4 is an isometric view of a mold of the protective barrier of the embodiment of FIG. 1.

FIG. 3 shows the structure of fluid ejection head 22, electrical connector 24 and protective barrier 26 in more detail. Fluid ejection head 22 is formed by depositing thin films on a die 30, which includes a fluid ejection region 32 having a plurality of fluid ejection mechanisms (not shown). Die 30 typically takes the form of a semiconductor substrate, but may be formed from any other suitable type of substrate as well. A plurality of electrical contacts 34 are formed on the fluid ejection head 22 and coupled to a plurality of electrical leads 36, which are coupled to connector 24. Electrical contacts 34 are connected to corresponding fluid ejection mechanisms, permitting power to be selectively provided to the individual fluid ejection mechanisms and enabling the controlled ejection of fluid.

Protective barrier 26 may include a plurality of features that combine to protect contacts 34 and leads 36. For example, in one embodiment, protective barrier 26 includes a molded encapsulant 38 that extends over electrical contacts 34, and may also include an outer barrier in the form of a preformed mold 40 used to mold encapsulant 38. Encapsulant 38 is configured to encapsulate each contact 34 and associated leads 36 to electrically insulate each contact and associated lead from other contacts and leads. This may help to prevent damage from electrical shorts across the leads in the event of contamination by fluid, and also from mechanical features such as fluid ejection head wiping stations. Mold 40 also helps to protect contacts 34 and leads 36 from damage from wiping stations, and may protect encapsulant 38 from corrosion caused by the fluid, if the encapsulant material is susceptible to corrosion by the fluid.

Encapsulant 38 may be molded around contacts 34 and leads 36 by any suitable molding process. One example is as follows. First, mold 40 is positioned over a portion of cartridge 14, as shown in FIG. 2. A bottom inside portion 43 of mold 40 may serve as a molding surface to contain and shape encapsulant 38 during the molding process. Bottom inside portion 43 of mold 40 typically includes an opening 44 positioned over fluid ejection region 32 of fluid ejection head 22 that allows fluid ejected by the fluid ejection mechanisms to reach the printing medium. Bottom inside portion 43 of mold 40 also may include a depression 42 formed in the region of the mold that covers contacts 34 and leads 36 to appropriately space the mold from the contacts and leads. On the outer surface of the mold, depression 42 is a protrusion over the area of the contacts 34 and the leads 36. Mold 40 may also include an upturned side portion 45 to help contain encapsulant 38 during the molding process. In one embodiment, the side portion 45 extends to the cartridge body when the mold 40 is in place on the cartridge.

Mold 40 is placed over the bottom portion of cartridge 14 in such a manner that a space remains between the bottom of the cartridge and at least part of the bottom inside portion 43 of the mold. This spacing may be achieved in any desired manner. For example, the bottom portion 43 of mold 40 may curve away from the die as it extends away from opening 44. Alternatively, in the depicted embodiment, mold 40 rests upon a plurality of raised structures situated around the perimeter of the die, as described in more detail below. In this manner, mold 40 may be quickly and easily positioned on die 30 to have the correct spacing with respect to the die.

After placing positioning mold 40 over the portion of cartridge 14 as depicted in FIG. 2, a curable, moldable encapsulant material is added to the mold and cured to form encapsulant 38. The encapsulant material is typically added in a large enough quantity to fill the space between mold 40 and die 30 substantially completely. During the molding process, cartridge 14 is held in an orientation such that mold 40 and encapsulant 38 are positioned beneath fluid ejection head 22, rotated 180 degrees from that depicted in FIG. 2. This orientation may be referred to as an "upright" orientation for the purposes of explaining the depicted embodiment. After encapsulant 38 is cured, preformed mold 40 may be left adhered to cartridge 22, or may be removed so that encapsulant 38 acts alone as protective barrier 26.

The molding of encapsulant 38 over contacts 34 and leads 36 offers various advantages over other methods of forming a protective barrier around the contacts and leads. For example, a protective barrier could also be formed by first inverting cartridge 22 to the orientation shown in FIG. 2, and then applying a curable material over contacts 34 and leads 36 in liquid form via a syringe from above. However, this method of forming a protective barrier may pose some difficulties. For example, the rheology of curable material typically must be carefully controlled. While a low-viscosity curable material may fill the space between each contact and lead more quickly and thoroughly than a high-viscosity curable material, the low-viscosity curable material also may tend to run across the surface of the die too quickly, and thus may contaminate the openings of the fluid ejection mechanisms. Likewise, the use of a curable material with strong wetting properties may offer improved coverage of the leads and contacts, but also may have a higher risk of contaminating the fluid ejection mechanisms. Additionally, the speed of the application needle, the temperature of the application process and other environmental factors generally are matched to the rheology of the curable material, and carefully controlled during the encapsulation process. These environmental factors tend to change over time, so control of process may be changed dynamically.

Figure 7:
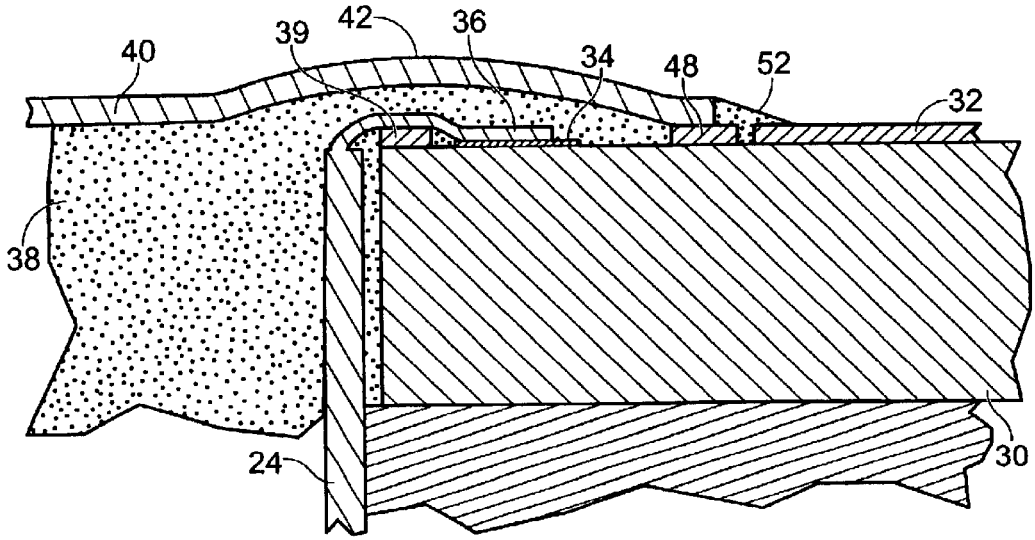
FIG. 7 is a sectional view of the mold, die and encapsulant of the embodiment of FIG. 1.

In contrast, in some embodiments, the use of mold 40 allows materials of a wide variety of viscosities to be easily applied via a low-precision process while limiting the danger of the encapsulant material contaminating the fluid ejection mechanisms. When applied via the above-described technique, the encapsulant material is positioned underneath cartridge 14 during application and curing. Thus, the encapsulant material is less likely to run and contaminate undesired portions of fluid ejection head 22 than when the material is applied directly onto die 30 from above, as gravity tends to hold the encapsulant material within bottom inside portion 43 of mold 40, whereas gravity tends to encourage the encapsulant material to wet the surface of the die when applied from above. Furthermore, as shown in FIG. 7, the inner edge of opening 44 of mold 40 may upon separators 48 that help to block the encapsulant from running towards the fluid ejection region 32. These structures are described in more detail below.

Any suitable material may be used to form encapsulant 38. As discussed above, the use of a curable liquid material with a relatively low viscosity may allow substantial coverage of all leads 34 and contacts 36 to be achieved more easily relative to a higher-viscosity encapsulant material. Furthermore, a low-viscosity material may flow into the spaces between leads 34 and contacts 36 more quickly than a high-viscosity material, and thus may help to decrease the amount of time to manufacture cartridge 14. The material used to form encapsulant 38 may also be selected based upon other properties as well. For example, it may be selected to have sufficient elasticity to avoid fracturing due to the thermal expansion or contraction of die 30, robustness to withstand repeated swipes over a fluid ejection head cleaning station commonly found in many fluid ejection devices, and/or chemical resistance to fluid corrosion. Suitable materials include, but are not limited to, epoxy materials. Examples of suitable epoxies include LOCTITE 3563, available from the Loctite Corporation, NAMICS CHIPCOAT, available from the Namics Corporation, and SIFEL 610, available from ShinEtsu Silicones of America.

In one embodiment, the material used to form encapsulant 38 may have any suitable pre-curing viscosity. Suitable pre-curing viscosities include dynamic viscosities within the range of between approximately 300 and 2500 centipoises, though viscosities outside of this range may also be used. Likewise, encapsulant 38 may have any suitable dimensions. For example, encapsulant 38 may have a thickness of 75–100 microns in the region of depression 42. In the regions adjacent outside of depression 42, encapsulant 38 may have the same thickness as the height of flow channel separators 48, which are described in more detail below.

As mentioned above, mold 40 may be left on cartridge 14 after the encapsulant molding process to form part of protective barrier 26. This may offer some advantages over removing mold 40 after completing the encapsulant molding process. For example, because mold 40 is not applied as a curable viscous material, it may potentially be made from a wider selection of materials than encapsulant 38, some of which may have more favorable chemical and mechanical properties than the encapsulant material. One example of a suitable material for mold 40 is stainless steel. Stainless steel is resistant to corrosion caused by fluids, fracture from thermal expansion, and mechanical damage caused by fluid ejection head wiping stations, and is easily formed into the shape of mold 40. Furthermore, the electrical conductivity of stainless steel does not affect contacts 34 and leads 36, as the contacts and leads are electrically insulated from mold 40 by encapsulant 38. Other suitable materials from which mold 40 may be formed include, but are not limited to, other metals, such as aluminum, and various polymer materials. Where mold 40 is left on cartridge 14 after the molding process, it may be adhered to the cartridge in any suitable manner. In some embodiments of the invention, mold 40 is adhered to cartridge 14 by the encapsulant after the encapsulant has cured.

The walls of mold 40 may have any suitable thickness. Where mold 40 is made from stainless steel foil, an exemplary range of thickness for mold 40 is between approximately 62 and 87 microns, although foils of thicknesses outside of this range may also be used. The use of a metal foil to form mold 40 offers the advantage that the mold may be easily constructed from a single piece of the foil by a simple forming process.

When mold 40 is left in place after the encapsulant molding process, a very small area between the edge of the mold and the die may remain unfilled by encapsulant 38. Where this unfilled area exists, it may be possible for fluid to contaminate this area. To prevent this space from forming, or to prevent fluid from contaminating this space, either die 30 or mold 40 may include structure that permits the encapsulant material to flow into the region between edge 50 of the mold and the die to form a seal.

Figure 5:
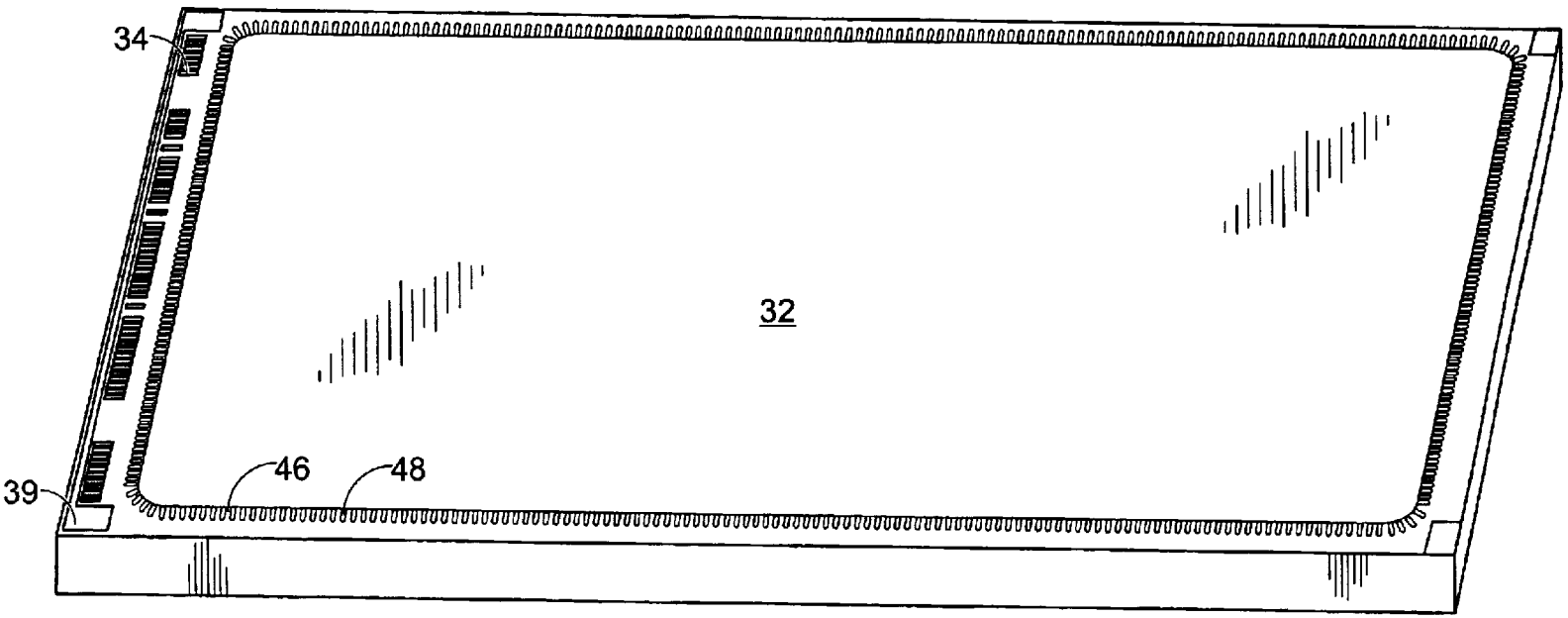
FIG. 5 is a front perspective view of a die of the embodiment of FIG. 1.
Figure 6:
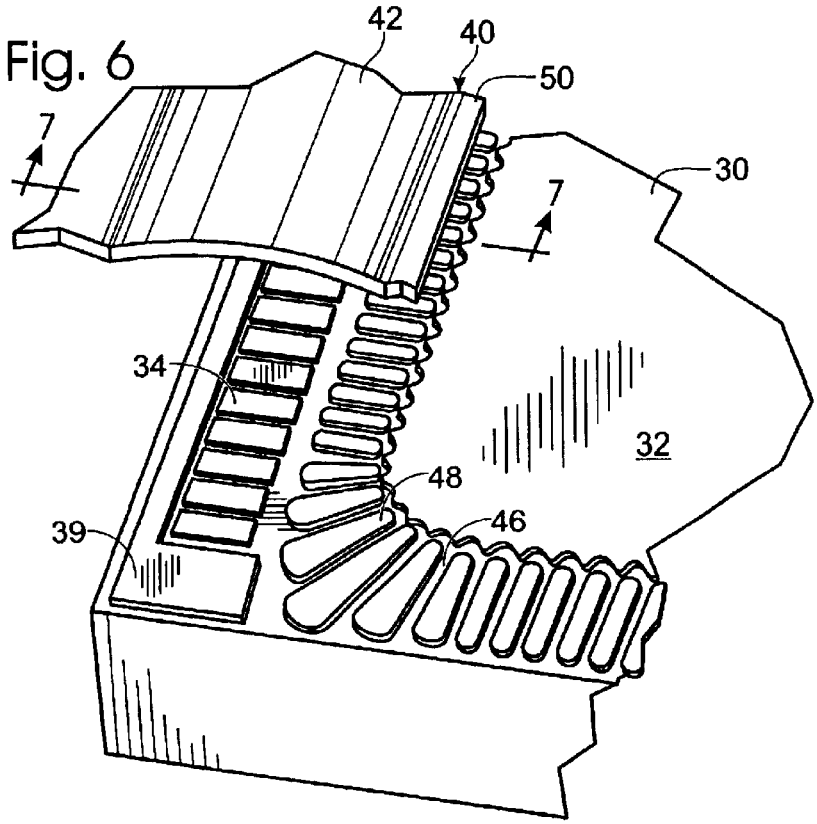
FIG. 6 is a magnified, partially-broken away isometric view of the mold and die of the embodiment of FIG. 1, with the encapsulant omitted for clarity.

One suitable structure for permitting this seal to form is shown in FIGS. 5 and 6 as a series of flow channels 46 formed in the surface of die 30. Flow channels 46 are separated and/or defined by a plurality of flow channel separators 48 that take the form of raised areas between the flow channels. Flow channels 46 may act as capillary channels to wick encapsulant into the region of die 30 underneath the edge of mold 40. Flow channels 46 may be formed on die 30 in any suitable manner, for example, by masking the regions of die 30 where flow channel separators 48 will be located (as well as other regions of the die that are not to be etched) with a photo-imageable material, and then etching the surface of the die. Alternatively, a series of flow channels may be formed in edge region 50 on bottom inner surface 43 of mold 40, instead of in die 30. Where the flow channels are formed in the surface of die 30, as in the depicted embodiment, the flow channel separators may be formed from an oxide layer (or other electrically insulating layer) formed on the top surface of the die. If desired, an insulating strip 39 may also be formed along the edge of die 30 to further help to insulate leads 36 from the bulk of die 30. Insulating strip 39 is located within encapsulated area, between leads 36 and die 30, and between contacts 34 and edge of die 30, along one side of die 30. Insulating strip 39 may be formed by the same etching step as flow channels 46, or may be formed via a separate processing step.

Flow channels 46 may have any suitable shape. The depicted flow channels 46 have an elongate shape, and each flow channel connects to adjacent flow channels at each end. However, the flow channels could also have a finger-like shape with only one open end, in which case flow channel separators 48 would connect at one end to fluid ejection region 32 of die 30. Likewise, flow channels 46 may also have any suitable dimensions. Exemplary dimensional ranges include a depth of between approximately 20 and 35 microns, a length of between approximately 250 and 500 microns, and a width of between approximately 30 and 150 microns, though flow channels 46 may also have dimensions outside of these ranges.

FIGS. 6 and 7 show the junction between die 30 and mold 40 in more detail. The encapsulant is omitted from FIG. 6 for clarity. Referring to FIG. 6, edge region 50 of mold 40 is configured to rest against the top surfaces of flow channel separators 48. Because flow channel separators 48 extend above flow channels 46, edge region 50 does not contact the bottom surfaces of flow channels 46. Thus, the encapsulant material is free to flow through flow through channels 46 when added to mold 40. Referring next to FIG. 7, a thin strip 52 of encapsulant 38 may be formed around edge region 50 from encapsulant material that flowed through flow channels 46, thus helping to seal any small gaps that may exist between edge region 50 and the surface of die 30. Selection of an encapsulant material with suitable wetting properties may help to prevent the encapsulant from wetting fluid ejection region 32. After curing, encapsulant 38 covers an outer portion of connector 24, and an inner portion of connector 24 between the connector and die 30. In this embodiment, encapsulant 38 isolates each electrical contact from adjacent electrical contacts. Thus, the largest part of the outer surface of protective barrier 26 is formed by mold 40, and only thin strip 52 of encapsulant 38 remains exposed where it seals the gap between edge region 50 and die 30.

Although the present invention has been disclosed in specific embodiments thereof, the specific embodiments are not to be considered in a limiting sense, because numerous variations are possible. The subject matter of the invention includes all novel and nonobvious combinations and subcombinations of the various elements, features, functions, and/or properties disclosed herein. The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of features, functions, elements, and/or properties may be claimed through amendment of the present claims or through presentation of new claims in this or a related application. Such claims, whether broader, narrower, equal, or different in scope to the original claims, also are regarded as included within the subject matter of the invention of the present disclosure.

What is claimed is:

1. A cartridge, comprising:

a body;

a die coupled with the body, wherein the die has a fluid ejection mechanism and an electrical contact to the fluid ejection mechanism;

an electrical connector extending along a side of the die and a side of the body, the electrical connector coupled with the electrical contact;

a molded encapsulant covering the electrical contact, and at least a portion of the electrical connector; and a mold adhered to the molded encapsulant, wherein the mold includes an opening positioned over the fluid ejection mechanism to allow fluid ejected by the fluid ejection mechanism to reach the printing medium.

2. The cartridge of claim 1, wherein the mold includes an inner edge defining the opening, and wherein the inner edge surrounds the fluid election region of the die.

3. The cartridge of claim 1 wherein the mold is made of stainless steel.

4. The cartridge of claim 1 wherein the mold has a thickness of between approximately 62 and 87 microns.

5. The cartridge of claim 1, wherein the molded encapsulant is an epoxy adhesive.

6. The cartridge of claim 1, wherein the molded encapsulant is formed from a curable material with a pre-curing dynamic viscosity of between approximately 300 and 2500 centipoises.

7. A cartridge comprising:

a body;

a die coupled with the body, wherein the die has a fluid ejection mechanism and an electrical contact to the fluid ejection mechanism;

an electrical connector extending along a side of the die and a side of the body, the electrical connector coupled with the electrical contact; and a molded encapsulant covering the electrical contact and at least a portion of the electrical connector, a mold having an edge region, wherein a plurality of flow channels are formed in the die to receive the molded encapsulant in a pre-cured state, wherein the flow channels are separated by a plurality of separators, and wherein the edge region of the mold contacts the separators such that molded encapsulant flows through the flow channels beneath the edge region of the mold during manufacturing.

8. The cartridge of claim 7, wherein molded encapsulant flows through the flow channels to form a strip of the molded encapsulant around the edge region of the mold.

9. The cartridge of claim 7, wherein the flow channels are etched into the die.

10. The cartridge of claim 7, wherein the flow channels have a depth of between approximately 20 and 35 microns.

11. The cartridge of claim 7, wherein the flow channels have a length of between approximately 250 and 500 microns.

12. The cartridge of claim 7, wherein the flow channels have a width of between approximately 30 and 150 microns.

13. A print cartridge, comprising:

a printhead configured to eject a fluid onto a printing medium, wherein the printhead includes a die having an electrical contact and also includes a fluid election region having at least one fluid ejection mechanism configured to eject the fluid onto the printing medium;

a connector coupled to the die for electrically connecting the die to off-printhead circuitry, the connector including a lead that is bonded to the electrical contact on the die; and a preformed barrier coupled with the die, wherein the preformed barrier covers the lead and the electrical contact to protect the lead and the electrical contact from the fluid, and wherein the preformed barrier includes an opening positioned over the fluid ejection region to allow fluid ejected by the fluid election mechanism to reach the printing medium.

14. The print cartridge of claim 13, wherein the opening is defined by an inner perimeter of the preformed barrier.

15. The print cartridge of claim 13, further comprising an encapsulant disposed between the preformed barrier and the die.

16. The print cartridge of claim 13, wherein the barrier is removable.

17. The print cartridge of claim 15, wherein at least a portion of the preformed barrier is separated from the die by a space, and wherein the encapsulant substantially completely fills the space between the portion of the preformed barrier and the die.

18. The printing cartridge of claim 13, wherein the barrier includes a raised portion disposed generally adjacent the electrical contact and the lead.

19. A print cartridge comprising:

a printhead configured to eject a fluid onto a printing medium, wherein the printhead includes a die having an electrical contact, the die having a perimeter, wherein a plurality of flow channels are formed in the die adjacent the perimeter of the die to accommodate a fluid encapsulant material;

a connector coupled to the die for electrically connecting the die to off-printhead circuitry, the connector including a lead that is bonded to the electrical contact on the die; and a preformed barrier coupled with the die, wherein the preformed barrier is configured to protect the lead and the electrical contact from the fluid.

20. The print cartridge of claim 19, wherein the flow channels are etched into the die.

21. The print cartridge of claim 19, wherein the flow channels are separated by a plurality of separators, and wherein the preformed barrier has an edge region in contact with the plurality of separators.

22. The print cartridge of claim 21, wherein a strip of encapsulant material is formed around the edge region of the preformed barrier.

23. A mold configured to be coupled to a fluid ejection head die to allow a protective material to be molded around a plurality of contact pads on the die, the fluid ejection head die including a fluid ejection mechanism configured to eject a fluid, the mold comprising:

a molding surface configured to cover the contact pads, wherein the molding surface is configured to support and shape the protective material during molding;

at least one side extending away from the molding surface, wherein the side is configured to contain the protective material during molding; and an opening configured to be positioned over the fluid ejection mechanism when the mold is coupled to the die to pass fluids ejected by the fluid ejection mechanism.

24. The mold of claim 23, wherein the mold is made of a material that is resistant to corrosion.

25. The mold of claim 23, wherein the mold is made of stainless steel.

26. The mold of claim 23, wherein the mold is formed from a single piece of material.

27. The mold of claim 23, wherein the mold includes a depression configured to accommodate the contact pads when the mold is coupled with the fluid ejection head die.

28. The mold of claim 23, wherein the opening includes is defined by an inner edge of the mold.

29. The mold of claim 23, wherein the mold is attached to a fluid ejection head.

30. A fluid ejection cartridge, comprising:

a body;

a fluid ejection head operably coupled with the body and including a fluid ejection mechanism configured to eject a fluid, wherein the fluid ejection head includes a die having an electrical contact;

a connector electrically coupled to the contact on the die; and molded barrier means for protecting the electrical contact and at least part of the connector from the fluid, the molded barrier means including an opening positioned over the fluid ejection mechanism to bass fluids ejected by the fluid ejection mechanism.

31. A method for protecting an electrical connection of a lead and a contact pad on a die in a fluid ejection head, the method comprising:

coupling a preformed mold with the die such that the preformed mold is positioned adjacent to and spaced from the electrical contact;

adding a moldable protective material between the preformed mold and the electrical contact; and removing the preformed mold after curing the moldable protective material.

32. A method for protecting an electrical connection of a lead and a contact pad on a die in a fluid ejection head, the fluid ejection head having a fluid ejection mechanism, the method comprising:

coupling a preformed mold with the die such that the preformed mold is positioned adjacent to and spaced from the electrical contact, and such that an opening in the preformed mold is positioned over the fluid ejection mechanism; and adding a moldable protective material between the preformed mold and the electrical contact.

33. The method of claim 32, wherein the preformed mold includes a raised area positioned adjacent the lead and contact before the moldable protective material is added.

34. The method of claim 32, wherein the moldable protective material is added in a fluid form.

35. The method of claim 32, further comprising curing the moldable protective material after adding the moldable protective material between the preformed mold and the electrical contact.

36. The method of claim 32, wherein the preformed mold remains bonded to the die by the moldable protective material.

37. The method of claim 32, wherein the moldable protective material is an epoxy adhesive.

38. The method of claim 32, wherein the moldable protective material has a pre-curing viscosity of between approximately 300 and 2500 centipoises.

39. A method for protecting an electrical connection of a lead and a contact pad on a die in a fluid ejection head, the method comprising:

coupling a preformed mold with the die such that the preformed mold is positioned adjacent to and spaced from the electrical contact; and adding a moldable protective material between the preformed mold and the electrical contact, wherein the die includes a plurality of recessed flow channels, and wherein the mold is configured to rest against the die above the flow channels so that moldable protective material flows through the flow channels and beneath the mold during molding.

* * * * *

UNITED STATES PATENT AND TRADEMARK OFFICE

CERTIFICATE OF CORRECTION

PATENT NO. : 6,764,165 B2
DATED : July 20, 2004
INVENTOR(S) : Aschoff et al.

It is certified that error appears in the above-identified patent and that said Letters Patent is hereby corrected as shown below:

Column 6,
Line 67, delete “election” and insert in lieu thereof -- ejection --;

Column 7,
Lines 45 and 57, delete “election” and insert in lieu thereof -- ejection --;

Column 9,
Line 2, delete “bass” and insert in lieu thereof -- pass --.

Signed and Sealed this

Thirtieth Day of November, 2004

JON W. DUDAS
*Director of the United States Patent and Trademark Office*